US011614281B2

(12) United States Patent
Park et al.

(10) Patent No.: US 11,614,281 B2
(45) Date of Patent: Mar. 28, 2023

(54) EQUIPMENT FOR REDUCING SPECIFIC AIR POLLUTANT GENERATED FROM HEATED ASPHALT CONCRETE WITH PROPORTIONAL CONTROL

(71) Applicant: SG CO., LTD., Incheon (KR)

(72) Inventors: Chang Ho Park, Incheon (KR); Hyun Soo Han, Goyang-si (KR)

(73) Assignee: SG CO., LTD., Incheon (KR)

( * ) Notice: Subject to any disclaimer, the term of this patent is extended or adjusted under 35 U.S.C. 154(b) by 263 days.

(21) Appl. No.: 17/182,918

(22) Filed: Feb. 23, 2021

(65) Prior Publication Data

US 2021/0372699 A1 Dec. 2, 2021

(30) Foreign Application Priority Data

May 27, 2020 (KR) ..... 10-2020-0063466
Aug. 27, 2020 (KR) ..... 10-2020-0108633

(51) Int. Cl.

| | |
|---|---|
| ***F26B 25/00*** | (2006.01) |
| ***F26B 11/04*** | (2006.01) |
| ***F26B 11/18*** | (2006.01) |
| ***F26B 23/02*** | (2006.01) |

(52) U.S. Cl.

CPC ..... *F26B 25/007* (2013.01); *F26B 11/049* (2013.01); *F26B 11/182* (2013.01); *F26B 23/022* (2013.01)

(58) Field of Classification Search

CPC .... F26B 25/007; F26B 11/049; F26B 11/182; F26B 23/022; F26B 21/04; F23G 7/06; B28C 7/0007; B01D 46/04; B01D 46/446; B01D 46/71; B01D 46/023; B01D 53/005; B01D 53/30; B01D 2258/0233; E01C 19/1013; E01C 19/08

USPC ..... 34/82

See application file for complete search history.

(56) References Cited

U.S. PATENT DOCUMENTS

| | | | | |
|---|---|---|---|---|
| 5,737,849 A * | 4/1998 | Morrison | E01C 19/1063 | 34/135 |
| 6,393,727 B1 * | 5/2002 | Seelig | F26B 23/022 | 34/396 |
| 2013/0152826 A1 * | 6/2013 | Stoffel | C04B 7/4423 | 106/745 |

FOREIGN PATENT DOCUMENTS

| | | |
|---|---|---|
| KR | 10-2010-0063098 A | 6/2010 |
| KR | 10-2076356 B1 | 2/2020 |

* cited by examiner

*Primary Examiner* — John P McCormack
(74) *Attorney, Agent, or Firm* — Novick, Kim & Lee PLLC; Jae Youn Kim

(57) ABSTRACT

Proposed is an equipment for reducing specific air pollutants generated from heated asphalt concrete with proportional control, which includes: a dryer for heating and drying aggregates and for burning harmful gases introduced through nozzles mounted thereon; a first dust remover for removing dust from the harmful gases emitted from the dryer; a fine dust remover for filtering fine dust from the remaining gases and dust; a bypass damper for returning some of the gases and dust emitted from the first dust remover to a second dust remover; the second dust remover for filtering the dust in the gases and dust emitted from the first dust remover; and a blower for feeding the gases exhausted from the second dust remover to the dryer, wherein clean gas exhausted from the fine dust remover is emitted to the air through an exhaust fan and a stack.

6 Claims, 11 Drawing Sheets

EQUIPMENT FOR REDUCING SPECIFIC AIR POLLUTANT GENERATED FROM HEATED ASPHALT CONCRETE WITH PROPORTIONAL CONTROL

CROSS REFERENCE TO RELATED APPLICATION OF THE INVENTION

The present application claims the benefit of Korean Patent Application No. 10-2020-0063466 filed on May 27, 2020, and Korean Patent Application No. 10-2020-0108633 filed on Aug. 27, 2020, in the Korean Intellectual Property, the entire contents of which are incorporated herein by reference.

BACKGROUND OF THE INVENTION

Field of the Invention

The present invention relates to equipment for reducing specific air pollutants generated from heated asphalt concrete with proportional control, and more particularly, to equipment for reducing specific air pollutants generated from heated asphalt concrete with proportional control that is capable of reducing the dust generated while aggregates to be mixed with asphalt are being heated, changing a structure of a dryer for completely burning gases, and controlling an exhaust fan, a bypass damper, and a blower at the same time by means of a programmable logic controller (PLC) to thus maintain an appropriate negative pressure in the interior of the dryer, thereby suppressing the generation of the dust, improving combustion efficiency to decrease amounts of gases generated, and in advance preventing environmental pollution caused by the generated gases.

Background of the Related Art

Generally, asphalt concrete, which is manufactured by heating and mixing aggregates like gravel, crushed stone, and so on, additives, and asphalt as residue after the sorting of crude petroleum, under given conditions, is a material commonly used to all types of pavement.

A method for manufacturing asphalt concrete includes the steps of allowing aggregates transferred through a conveyor belt from a cold bin to pass through a dryer to remove the water contained in the aggregates and to heat the aggregates to an appropriate temperature at which the aggregates are mixed well with asphalt oil, allowing the heated aggregates to be subjected to a particle size adjusting process through a hot elevator, a hot screen, and a hot bin, injecting the aggregates adjusted in particle sizes into a mixer, and injecting an appropriate amount of asphalt oil heated in an asphalt oil storage into the mixer through a metering tank, and mixing the appropriate amount of asphalt oil with the aggregates to thus produce the asphalt concrete.

The produced asphalt concrete is loaded immediately on a truck and is thus moved to a pavement construction place. The method for manufacturing the asphalt concrete is carried out through 'storage equipment' of aggregates and stone powder, 'drying equipment' like the dryer, 'mixing equipment' for mixing heated aggregates with asphalt, 'dust collection equipment' for preventing air pollution, and 'asphalt concrete loading equipment', and among the five equipment, all of four equipment excepting the 'storage equipment' are in close relation with odor and pollutant emission.

Air pollutants generally emitted in the asphalt concrete manufacturing process are generated through ducted emission and fugitive emission when they are sorted according to their treatment. Through the ducted emission, first, the air pollutants are purified and emitted through pollution treatment equipment, which are generally emitted from the dryer, the hot elevator, the hot screen, the hot bin, and the mixer.

Through the fugitive emission, contrarily, scattering dust is generated during the asphalt concrete loading process on the truck, the aggregate storing in the cold bin, and the aggregate moving process, and so on.

That is, the main air pollutants include the dust and the organic fume generated while the asphalt oil becomes volatile, and the processes for emitting formaldehyde, acetaldehyde, and benzo[a]pyrene include the process for drying the aggregates, the process for storing the asphalt oil in the storage tank, the process for mixing the aggregates and the asphalt oil in the hot mixer, and the process for loading the produced asphalt concrete on the truck.

On the other hand, equipment for reducing specific air pollutants generated from heated waste asphalt concrete is proposed by the same applicant as in the invention, which is disclosed in Korean Patent No. 10-2076356.

As shown in FIG. 1, the conventional equipment for reducing specific air pollutants makes use of a burner in a dryer 10 as aggregate drying equipment to reburn odor and air pollutants generated while the waste asphalt concrete is being heated to sort the aggregates from the waste asphalt concrete, while having no separate device for removing the odor and air pollutants generated, thereby removing or minimizing the odor and air pollutants generated.

That is, the dryer 10 for drying the aggregates and dust collection equipment 20 for removing gases and dust generated from the dried aggregates are connected to a reproduction dryer 30 for heating the waste asphalt concrete, thereby further removing the odor and air pollutants generated while the waste asphalt concrete is being heated.

On the other hand, as shown in FIG. 2, a distributor 50 serves to distributedly emit the harmful gases transferred through a suction fan 40 by means of a plurality of thin ducts.

However, the ducts have small sizes, and in the process where the harmful gases are distributedly transferred through the ducts, a lot of pressure losses may be generated. In this case, further, the harmful gases do not flow gently along the ducts.

Also, the interiors of the ducts may be clogged due to dust, and so as to clean the ducts, accordingly, the ducts have to be separated from the distributor 50. In this case, however, it is hard to separate the ducts fixedly mounted onto the distributor 50 from the distributor 50.

If the diameters of the ducts are small, however, flow rates of the harmful gases become fast, and as shown in FIG. 3, a plurality of tangential entry type dampers into which the harmful gases are introduced are located along top outer peripheral surface of a combustion chamber 63 in a circumferential direction, so that vortexes are severely generated due to fast air stream in the combustion chamber 63 to thus increase an amount of dust.

SUMMARY OF THE INVENTION

Accordingly, the present invention has been made in view of the above-mentioned problems occurring in the related art, and it is an object of the present invention to provide equipment for reducing specific air pollutants generated from heated asphalt concrete with proportional control that is capable of reducing the dust generated while aggregates to be mixed with asphalt are being heated, changing a structure of a dryer for completely burning gases, and controlling an exhaust fan, a bypass damper, and a blower at the same time by means of a programmable logic controller (PLC) to thus maintain an appropriate negative pressure in the interior of the dryer, thereby suppressing the generation of the dust, improving combustion efficiency to decrease amounts of gases generated, and in advance preventing environmental pollution caused by the generated gases.

To accomplish the above-mentioned object, according to the present invention, there is provided equipment for reducing specific air pollutants generated from heated asphalt concrete with proportional control, the equipment including: a dryer for heating and drying aggregates and for burning harmful gases introduced through nozzles mounted thereon; a first dust remover for removing dust from the harmful gases emitted from the dryer and for exhausting the remaining gases and dust therefrom; a fine dust remover for filtering fine dust from the remaining gases and dust exhausted from the first dust remover through a plurality of filter bags to thus emit clean gas therefrom; a bypass damper located between the first dust remover and the fine dust remover to return some of the gases and dust emitted from the first dust remover to a second dust remover; the second dust remover for filtering the dust in the gases and dust emitted from the first dust remover to feed the filtered dust to an asphalt concrete manufacturing silo and to exhaust and feed the gases to the dryer again; and a blower for feeding the gases exhausted from the second dust remover to the dryer through an exhaust pipe, wherein the clean gas exhausted from the fine dust remover is emitted to the air through an exhaust fan and a stack.

According to the present invention, desirably, the equipment further includes a programmable logic controller (PLC) for automatically controlling the bypass damper and the blower to adjust the amount of gas fed to the dryer and for controlling the exhaust fan to adjust the amount of gas emitted through the stack, so that the interior of the dryer can be kept to an appropriate negative pressure.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
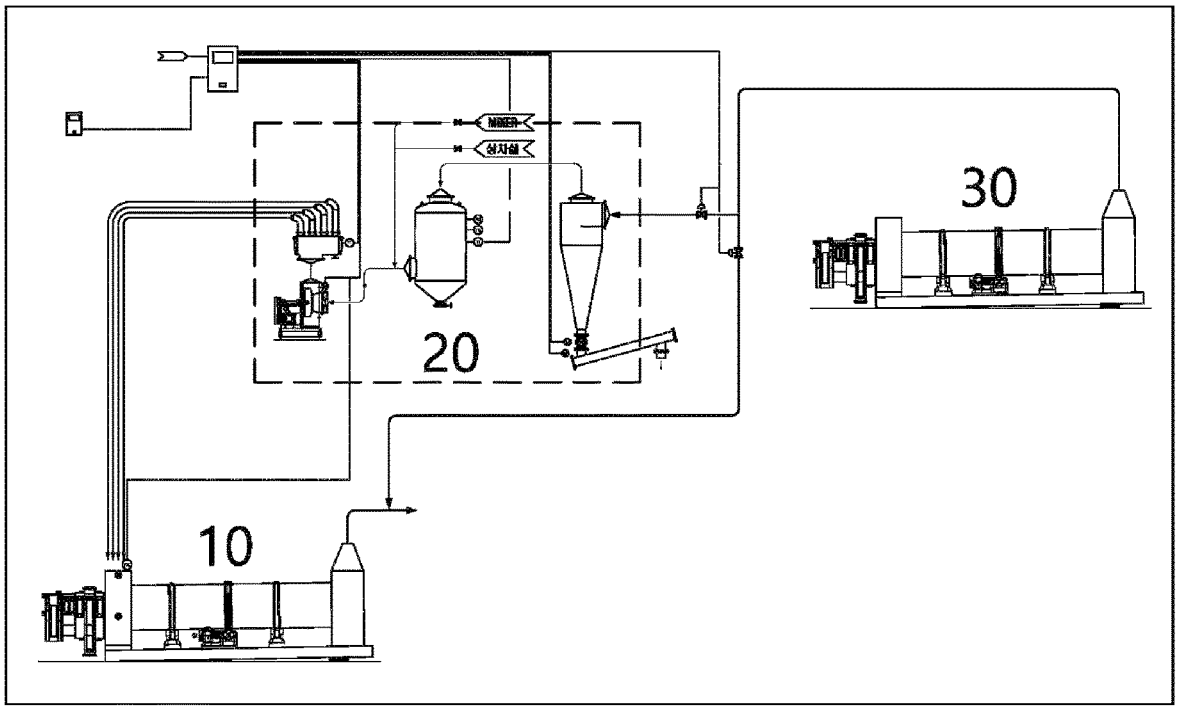
FIGS. 1 to 3 are schematic diagrams showing conventional equipment for reducing specific air pollutants.
Figure 2:
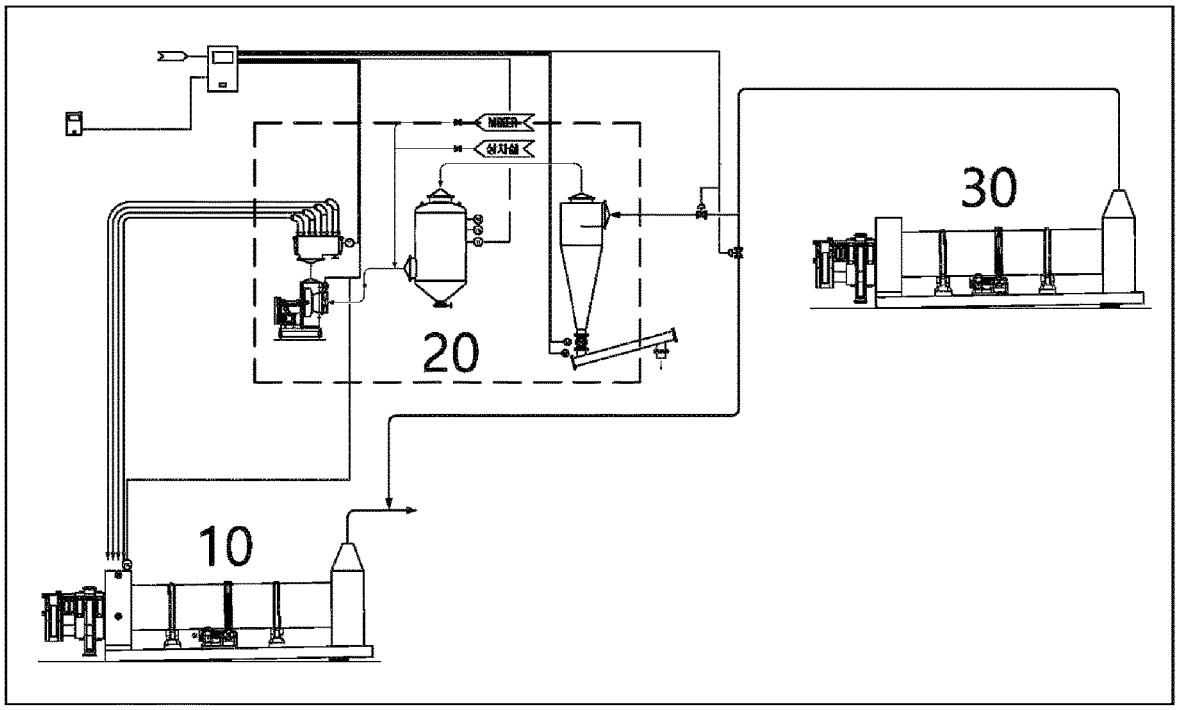
Figure 3:
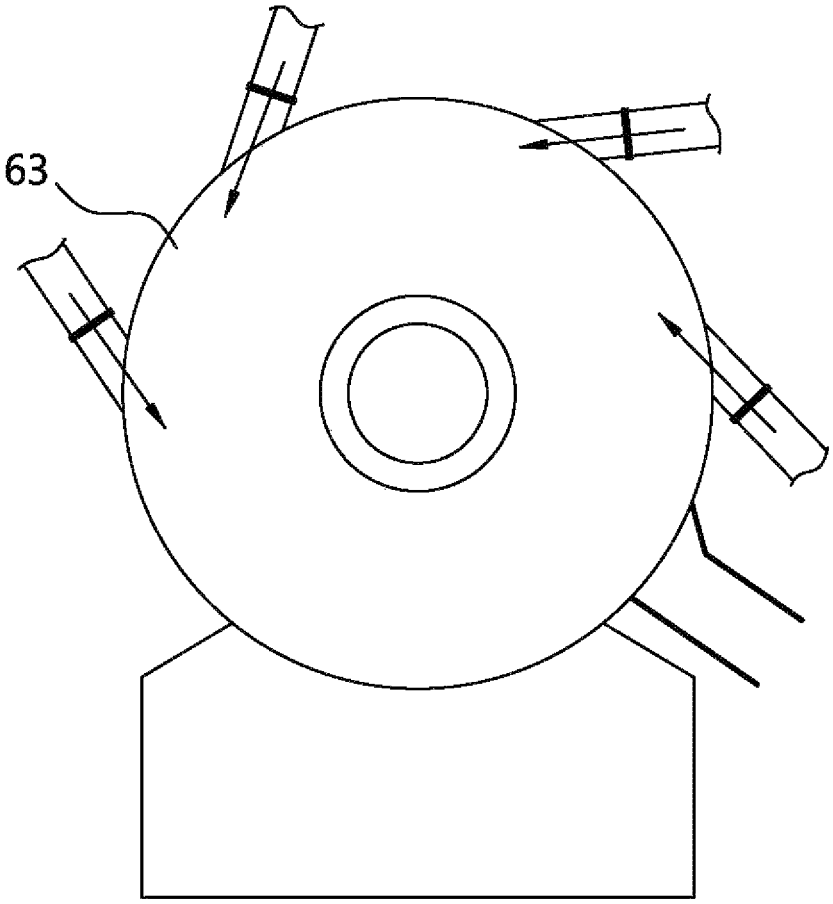

The present invention may be modified in various ways and may have several exemplary embodiments. Specific exemplary embodiments of the present invention are illustrated in the drawings and described in detail in the detailed description.

However, this does not limit the invention within specific embodiments and it should be understood that the invention covers all the modifications, equivalents, and replacements within the idea and technical scope of the invention. In the description, it should be noted that the parts corresponding to those of the drawings are indicated by corresponding reference numerals.

Terms, such as the first, the second, A, and B, may be used to describe various elements, but the elements should not be restricted by the terms.

The terms are used to only distinguish one element from the other element. For example, a first element may be named a second element without departing from the scope of the present invention. Likewise, a second element may be named a first element. A term 'and/or' includes a combination of a plurality of relevant and described items or any one of a plurality of related and described items.

When it is said that one element is described as being "connected" or "coupled" to the other element, one element may be directly connected or coupled to the other element, but it should be understood that another element may be present between the two elements. In contrast, when it is said that one element is described as being "directly connected" or "directly coupled" to the other element, it should be understood that another element is not present between the two elements.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

All terms used herein, including technical or scientific terms, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification.

Embodiments of the present invention will be described in detail below with reference to the accompanying drawings.

FIGS. 4 to 11 are schematic diagrams showing equipment for reducing specific air pollutants generated from heated asphalt concrete with proportional control according to the present invention.

The present invention relates to equipment for reducing specific air pollutants generated from heated asphalt concrete with proportional control according to the present invention, and the equipment includes a dryer 100, a first dust remover 200, a fine dust remover 300, an exhaust fan 400, a stack 500, a bypass damper 600, a second dust remover 700, a blower 800, and a programmable logic controller (PLC) 900.

The dryer 100 serves to heat and dry aggregates for producing asphalt concrete and at the same time to burn the harmful gases introduced from the blower 800 through nozzles.

The first dust remover 200 serves to remove dust from the harmful gases emitted from the dryer 100 and to thus emit the remaining gases and dust.

The fine dust remover 300 serves to filter fine dust from the remaining gases and dust emitted from the first dust remover 200 through filter bags to thus emit the fine dust therefrom.

Clean gas produced by removing the gases and dust through the fine dust remover 300 is exhausted to the air through the exhaust fan 400 and the stack 500.

The bypass damper 600 serves to return some of the gases and dust to the dryer 100, in the process where the gases and dust discharged from the dryer 100 are exhausted through the stack 500, to reduce amounts of the gases and dust emitted.

The second dust remover 700 serves to filter the dust from the gases and dust emitted from the dryer 100 to thus feed the filtered dust to an asphalt concrete manufacturing silo and serves to exhaust the gases emitted from the dryer 100 to thus feed the exhausted gases to the dryer 100 again.

The blower 800 serves to feed the gases emitted from the second dust remover 700 to the dryer 100 through an exhaust pipe.

The PLC 900 serves to control the bypass damper 600 and the blower 800 to adjust amounts of the gases fed to the dryer 100, thereby allowing the interior of the dryer 100 to be kept to an appropriate negative pressure, and serves to control the exhaust fan 400 to adjust amounts of the gases exhausted through the stack 500.

The dryer 100 includes a cylindrical drum 110 in which the aggregates are filled, a burner 120 for applying heat to the drum 110, and a combustion chamber 130 located between the drum 110 and the burner 120.

In the combustion chamber 130, the gases introduced through a gas inlet 140 and nozzles 150 coupled to a single duct connected to the blower 800 is burnt by means of flames of the burner 120.

When the drum 110 rotates by means of a rotation driver 160, the aggregates in the drum 110 are mixed, and through side rollers 170 and 180 located in front of and behind the rotation driver 160, the balance of the rotating drum 110 is kept.

As the combustion chamber 130 is heated by means of the flames of the burner 120, further, the aggregates filled in the interior of the rotating drum 110 are heated and dried by means of indirect heat passing through the combustion chamber 130, and accordingly, the harmful gases and dust generated from the interior of the drum 110 are emitted through an exhaust outlet 190.

Figure 5:
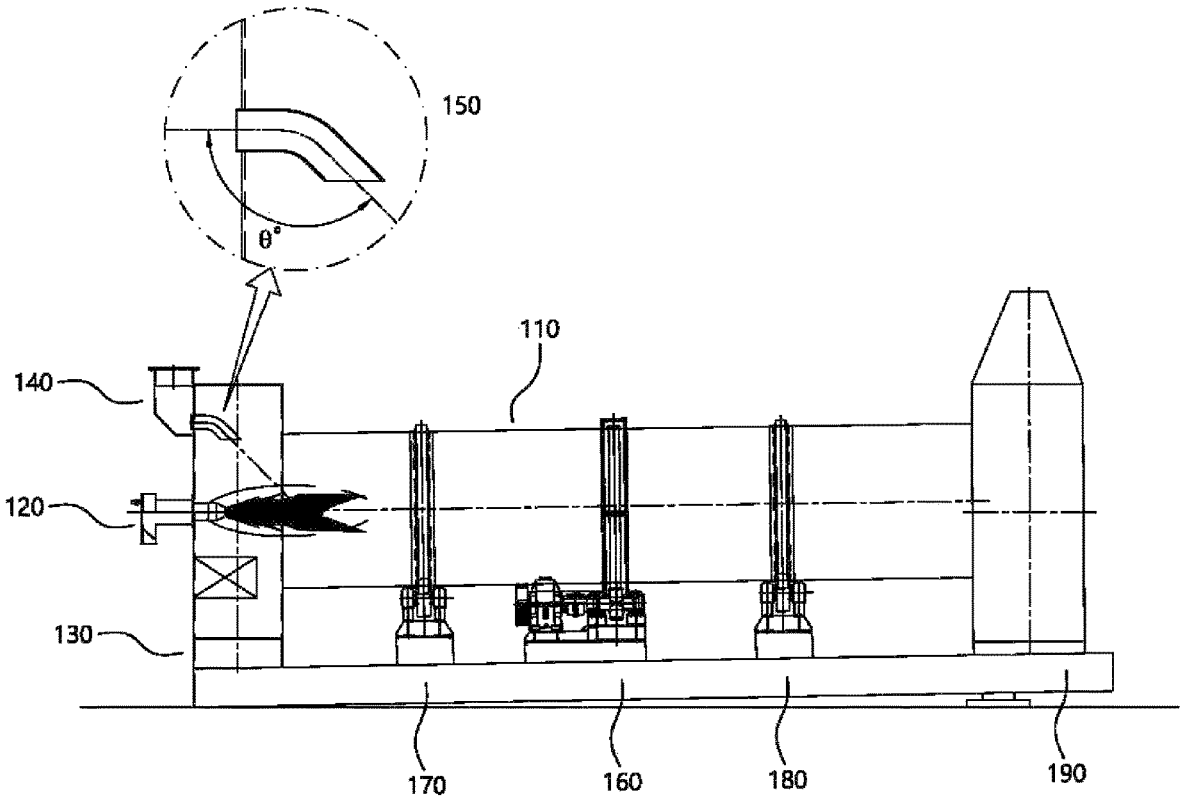

As shown in FIG. 5, the harmful gases introduced from the blower 800 through the single duct whose diameter is large are fed to the combustion chamber 130.

The single duct whose diameter is large is coupled to the inlet 140 formed on top of the side surface of the combustion chamber 130, and the harmful gases introduced through the inlet 140 are not fed directly to the combustion chamber 130. That is, the harmful gases are fed to the combustion chamber 130 through the long thin nozzles 150. As mentioned above, desirably, the multiple nozzles 150 are located in the interior of the combustion chamber 130.

Desirably, the single duct is designed to allow the flow rates of the gases fed to the combustion chamber 130 therethrough to be kept in the range of 12 to 15 m/sec.

The nozzles 150 connected to the single duct are symmetrically arranged on the combustion chamber 130 to allow the gases to be uniformly fed toward the flames (in the range of 1200 to 1500° C.) in the combustion chamber 130 therefrom.

Figure 6:
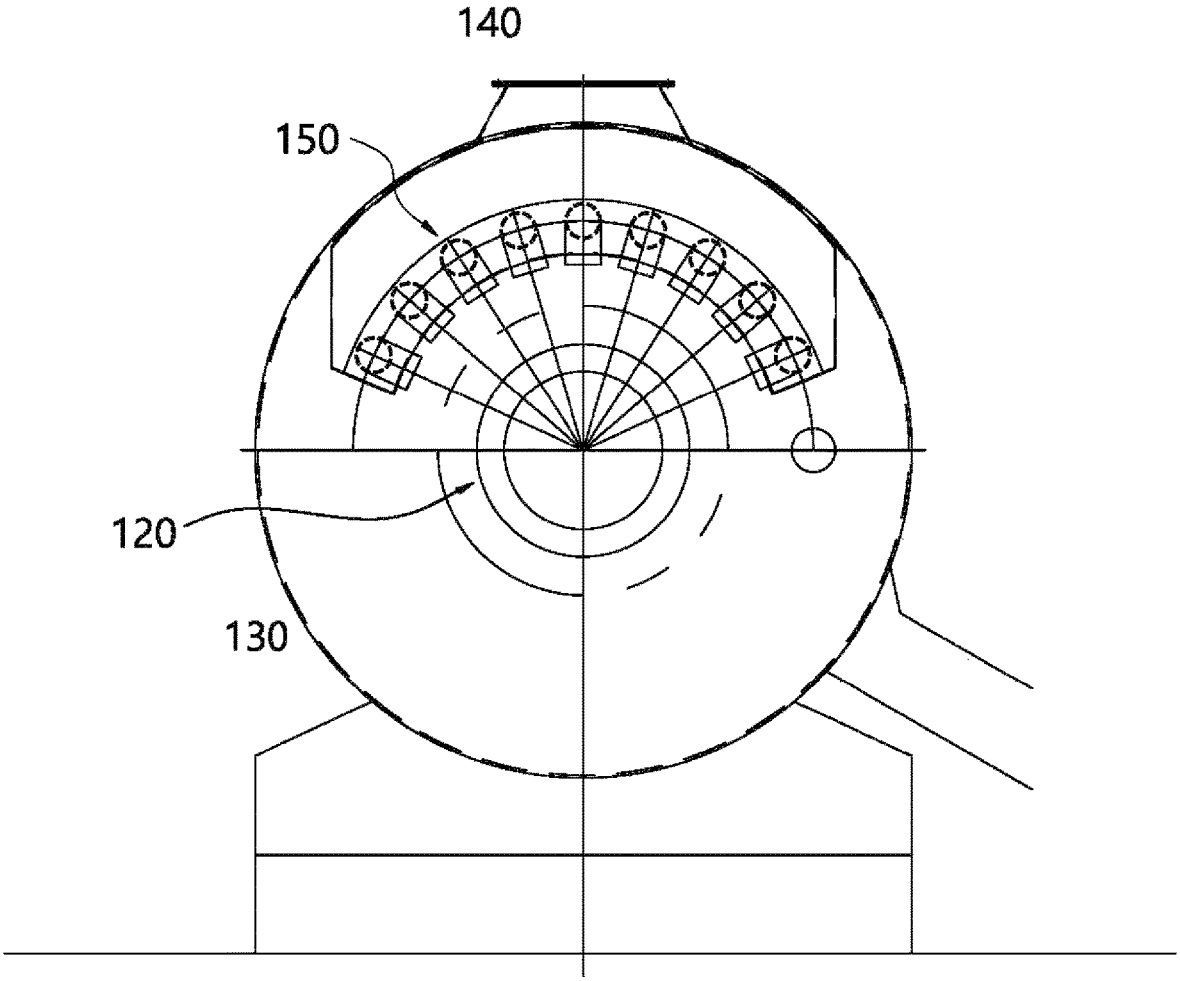
Figure 7:
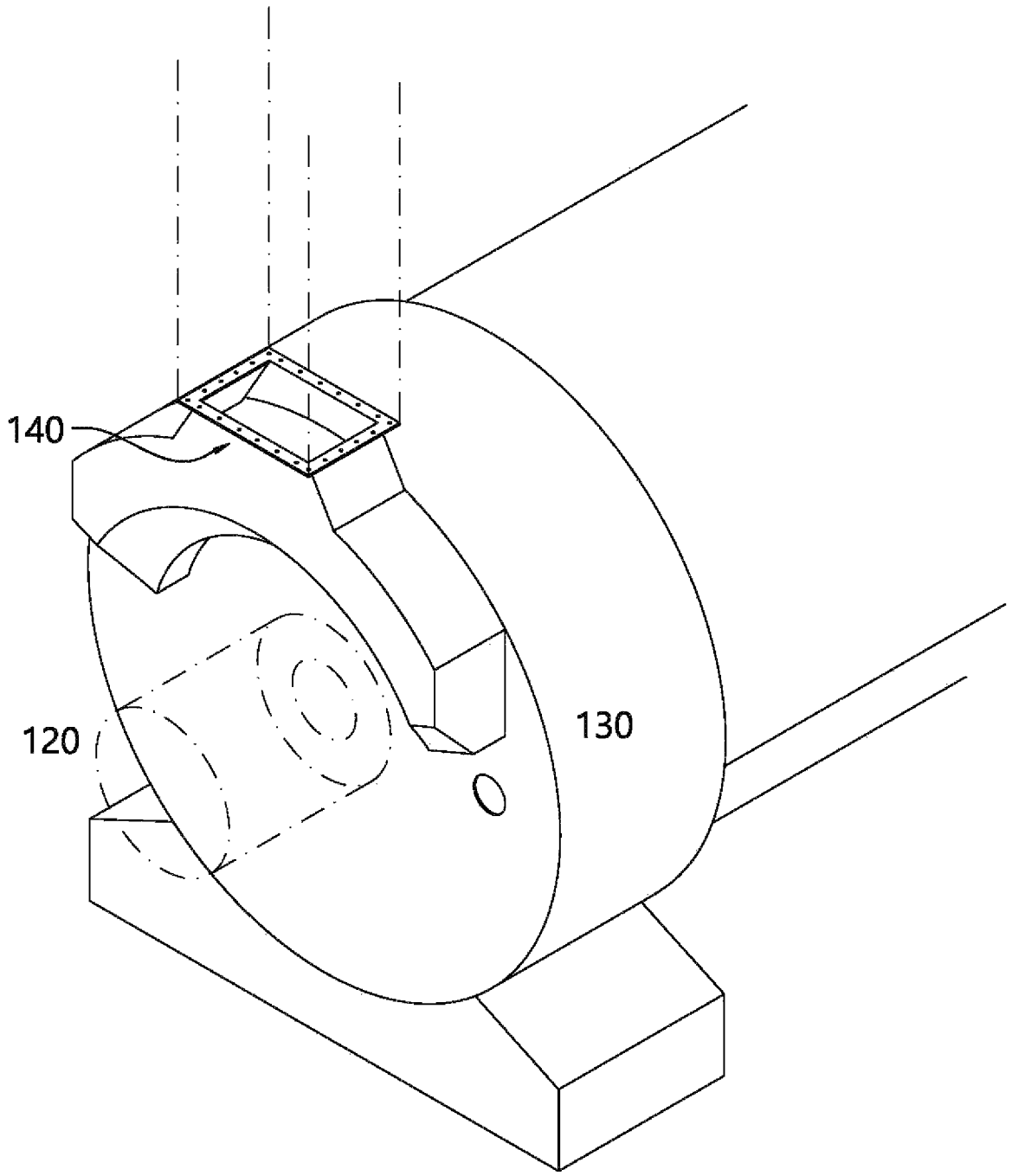
Figure 8:
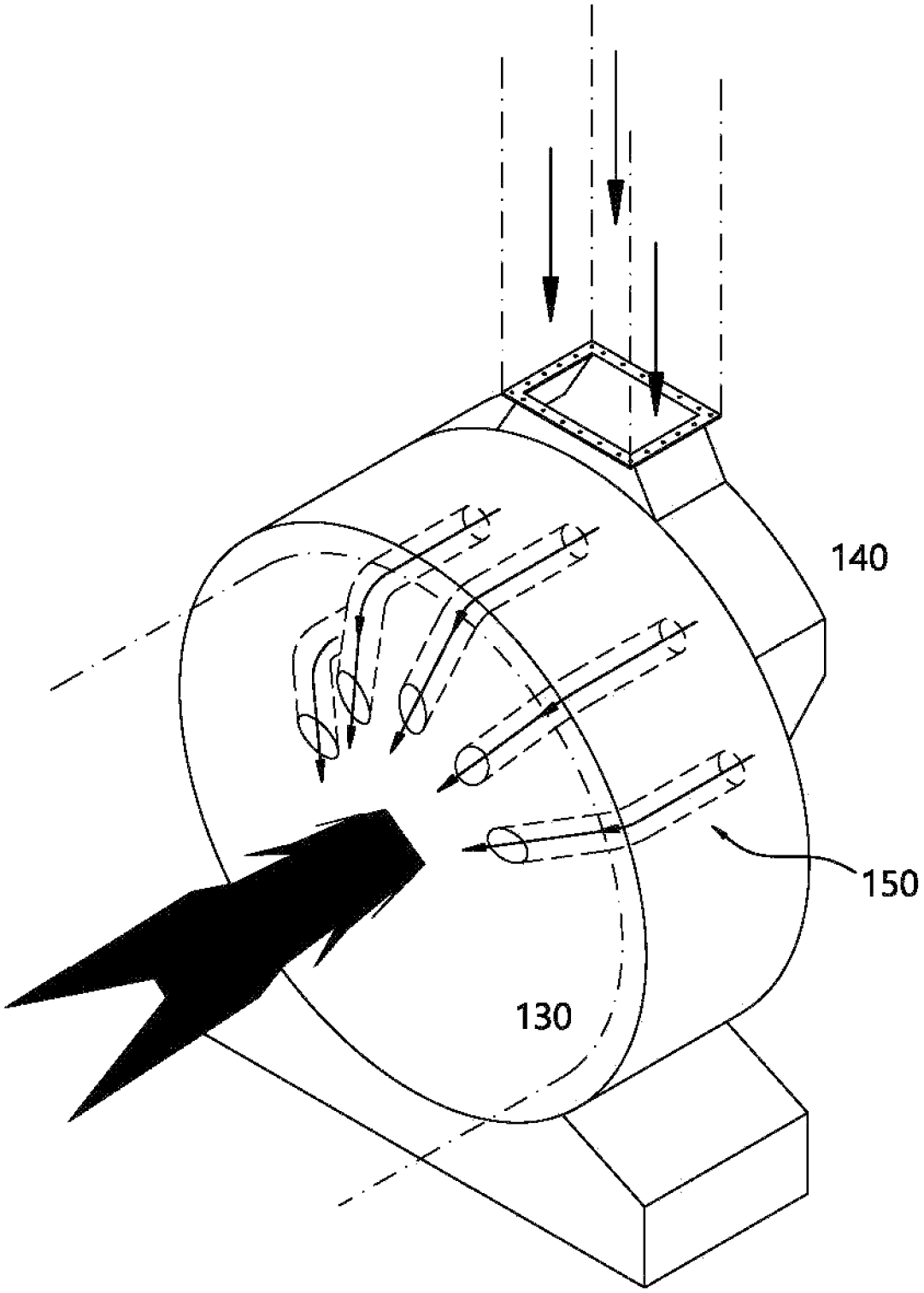

As shown in FIG. 6, desirably, the nozzles 150 are located in the combustion chamber 130 in such a manner as to be distributed symmetrically to the left and right with respect to a center line of the combustion chamber 130.

A front portion of each nozzle 150 is located parallel to the interior of the combustion chamber 130, but an end portion thereof is bent to the center of the combustion chamber 130 to feed the gases toward the flames of the burner 120 generated on the center of the combustion chamber 130.

According to the present invention, the injection angle Θ° of each nozzle 150 is kept to the range of 120 to 150° so as to allow the gases introduced into the combustion chamber 130 to be burnt through direct contact with the flames of the burner 120.

According to the present invention, desirably, the nozzles 150 are configured to make circles toward the flames of the burner 120, while injecting the gases into the center of the flames of the burner 120, thereby gently feeding the gases introduced into the combustion chamber 130 to the burner 120.

The shapes of the nozzles 150 are not limited to the circles as shown in FIG. 6, and they may be polygonal only if the gases introduced into the combustion chamber 130 are gently fed to the burner 120.

Figure 9:
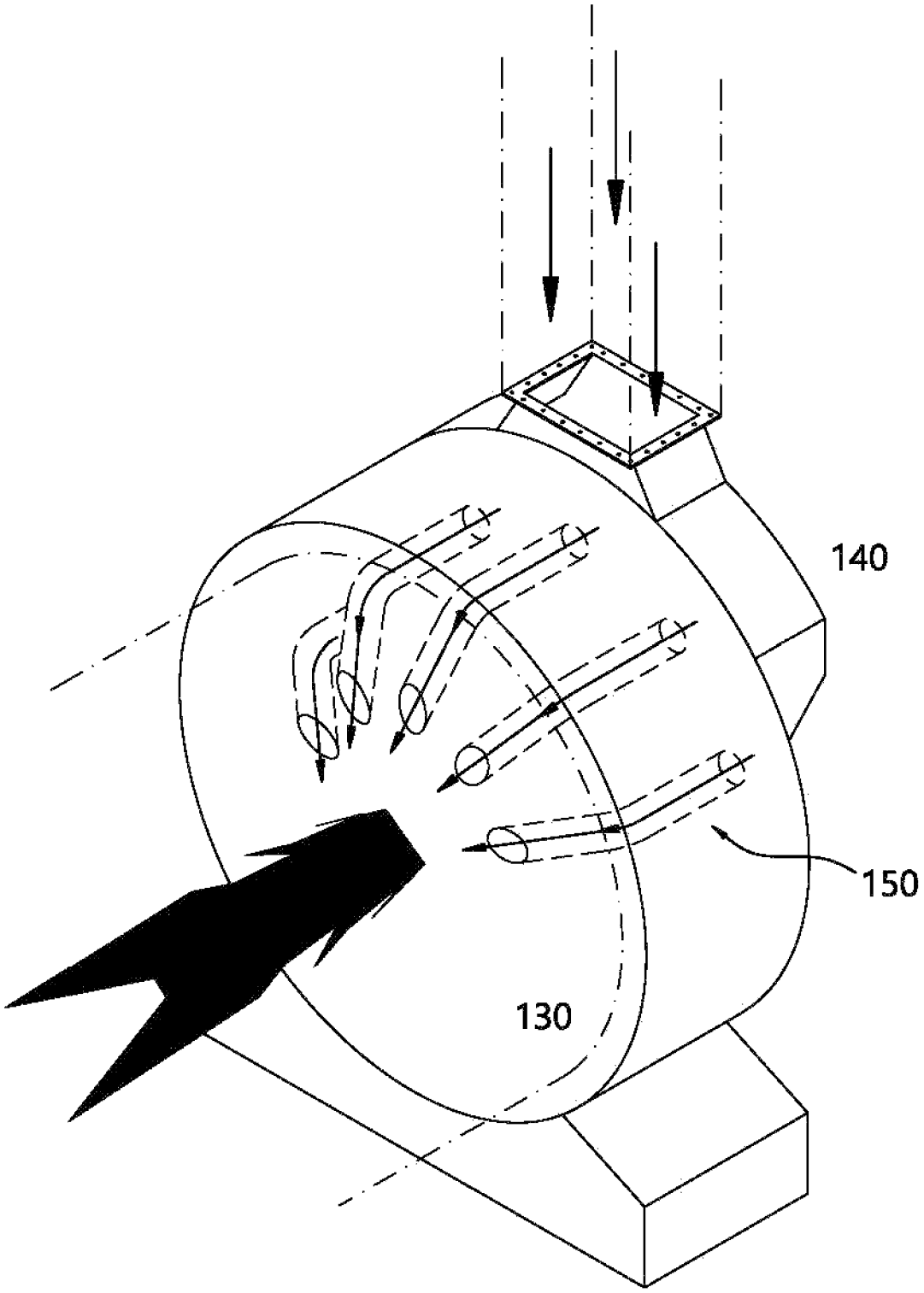
Figure 10:
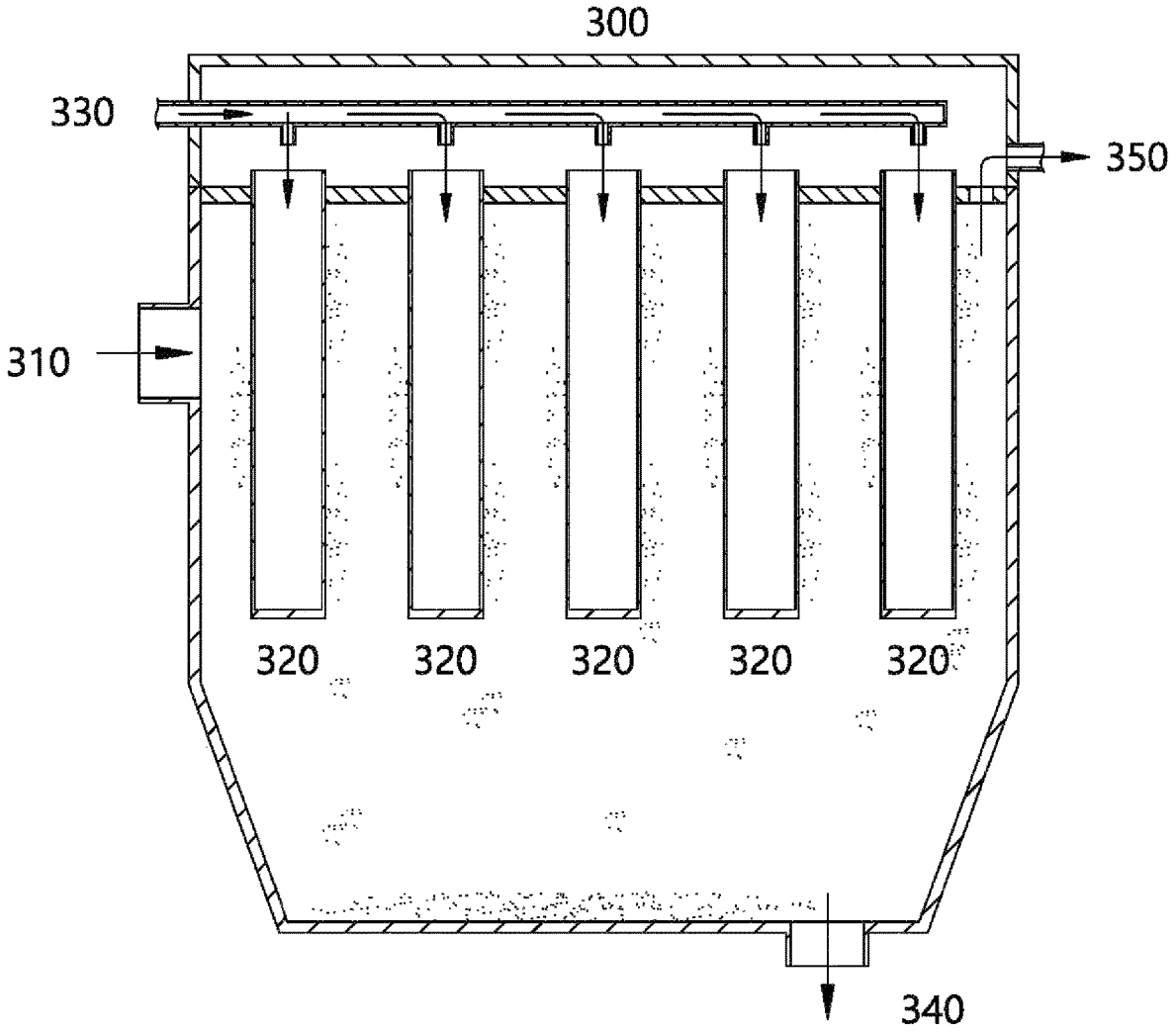

So as to gently feed the gases to the flames of the burner 120, in this case, the nozzles 150 are bent to the center of the flames in the combustion chamber 130, and further, as shown in FIG. 9, the nozzles 150 are located inclinedly toward the combustion chamber 130 from the inlet 140, without any bending.

Even in the case where the nozzles 150 are located inclinedly toward the combustion chamber 130 from the inlet 140, of course, the injection angle Θ° of each nozzle 150 is kept to the range of 120 to 150°.

As the gases introduced through the inlet 140 are injected into the flames of the burner 120, the gases introduced into the combustion chamber 130 can be prevented from rapidly escaping from the combustion chamber 130 to the outside, and at the same time, the harmful gases can be burnt by means of the flames of the burner 120.

The first dust remover 200 is configured to directly connect two cyclone systems and is connected to the exhaust outlet 190 of the dryer 100 through the single duct to suck the harmful gases including the odor and dust generated from the heated aggregates and gases. As a result, the first dust remover 200 exhausts the dust with relatively large particles in the dust contained in the sucked harmful gases to the outside through exhaust valves (not shown) located on the underside thereof.

The dust particles discharged through the exhaust valves of the cyclone systems are fed to a mixer (not shown) through a hot elevator and are then mixed with asphalt, additives, and aggregates.

The harmful gases and fine dust remaining in the first dust remover 200, after the dust with the relatively large particles has been removed, is transferred to the fine dust remover 300 through a duct line 310 located on an upper portion of the fine dust remover 300.

The fine dust remover 300 has a plurality of filter bags 320 located therein. The filter bags 320 are circular filters, and the fine dust, which cannot be filtered through the filter bags 320, are attached to the outer peripheral surfaces of the filter bags 320.

Above the filter bags 320, further, a line 330 is located to supply air to the filter bags 320.

Through the line 330, pulsing air is periodically supplied from a compressor (not shown) to which a timer is attached to the filter bags 320, and the pulsing air serves to drop the dust attached to the outer peripheral surfaces of the filter bags 320, so that the dust dropped is discharged through a fine dust discharge outlet 340 formed on the underside of the fine dust remover 300.

Clean gas remaining in the fine dust remover 300 after the fine dust has been removed from the filter bags 320 is exhausted through a gas exhaust outlet 350 formed on the upper portion of the fine dust remover 300, the exhaust fan 400, and the stack 500 sequentially to the air.

Through a check hole of the stack 500, degrees of pollution of the dust, gases, and odor exhausted through the stack 500 are measured, and the measured values are transmitted to the PLC 900.

The harmful gases and fine dust exhausted from the first dust remover 200 are transferred to the fine dust remover 300, but some of them are conveyed to the second dust remover 700 through the bypass damper 600 and a duct line.

The bypass damper 600 includes an automatic valve (not shown) operating by means of an actuator, and through the operation of the automatic valve, the harmful gases exhausted from the first dust remover 200 are transferred to the second dust remover 700.

Figure 11:
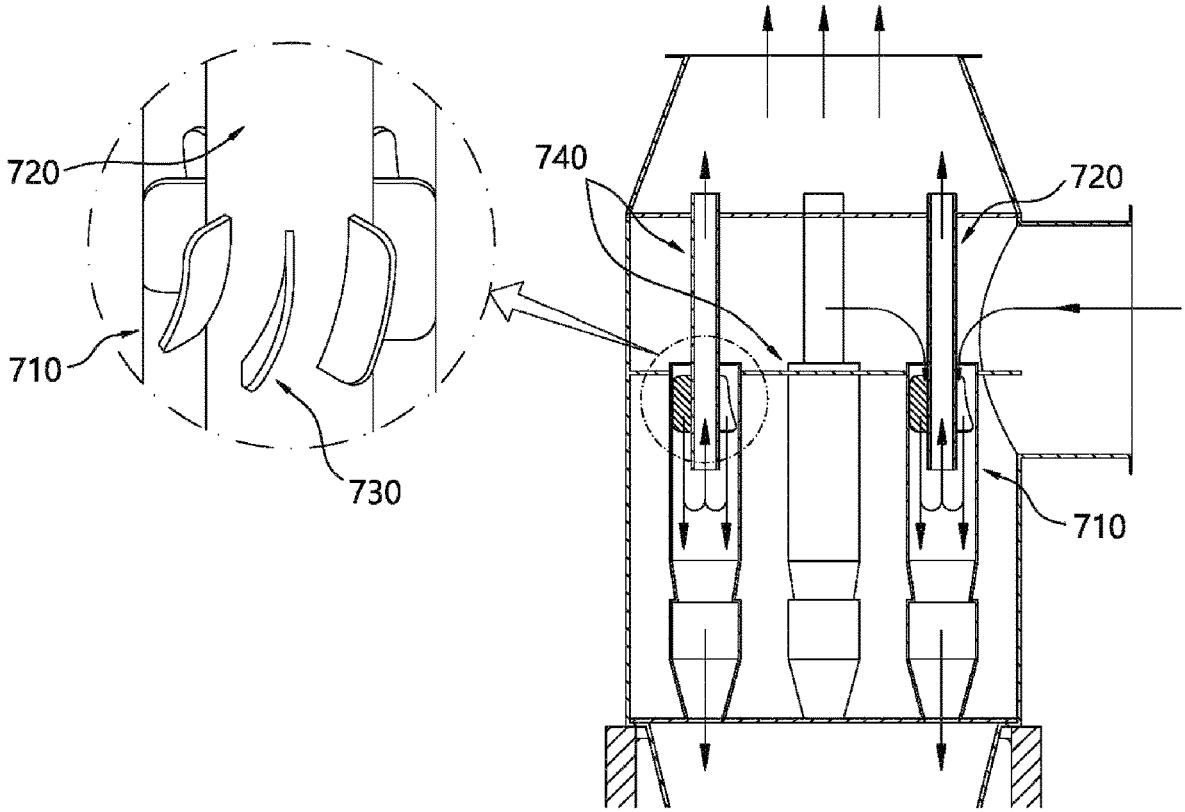

As shown in FIG. 11, the second dust remover 700 has an inlet formed on the side surface of the upper portion thereof to introduce the dust and harmful gases thereinto and a plurality of collection pipes 710 and a plurality of gas exhaust tubes 720 located in a hollow interior space thereof.

The dust and harmful gases introduced from the inlet of the second dust remover 700 are introduced into the collection pipes 710 in which cyclones are adopted, and the gases flowing downward through guide vanes 730 mounted on the gas exhaust tubes 720 are exhausted upwardly through the gas exhaust tubes 720, while the dust dropping downward through the guide vanes 730 is being collected to the cyclones and is then discharged therefrom.

Further, the second dust remover 700 has partition walls 740 located in the internal space thereof to limit the movements of the gases and dust, so that the gases moving to the dryer 100 through the gas exhaust tubes 720 is not mixed with the gases and dust introduced from the inlet formed on the side surface of the upper portion thereof.

The blower 800 is connected to the second dust remover 700 through a duct line to suck and transfer the harmful gases emitted through the second dust remover 700 to the dryer 100.

Figure 4:
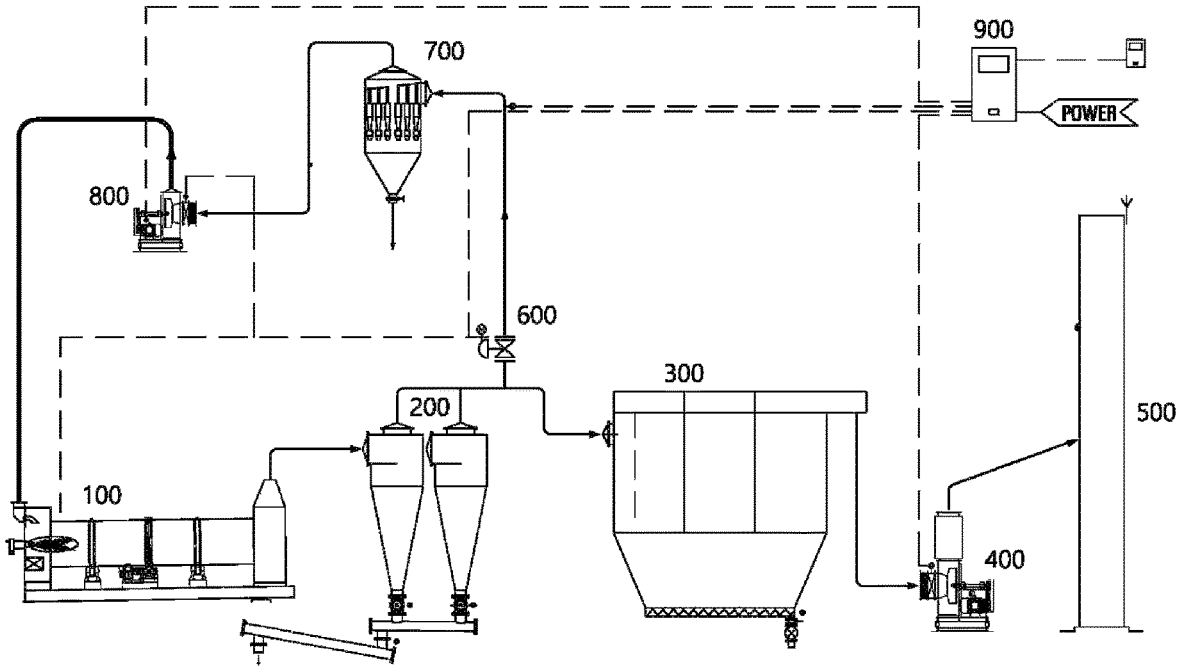
FIGS. 4 to 11 are schematic diagrams showing equipment for reducing specific air pollutants generated from heated asphalt concrete with proportional control according to the present invention.

The dryer 100 burns the harmful gases introduced through the nozzles 150 from the blower 800 and at the same time heats the aggregates for producing the asphalt concrete, which has been already explained with reference to FIG. 4.

Further, the interior of the dryer 100 has to be kept to a given negative pressure so as to prevent the harmful gases from being emitted to the outside, and desirably, the negative pressure is kept in the range of −10 to −15 $mmH_2O$. If the negative pressure is over the set range, backfire occurs to cause the flames of the burner 120 to be generated toward the inlet of the combustion chamber 130, and if the negative pressure is under the set range, a burning state is instable. Accordingly, the interior of the dryer 100 has to be kept to the above-mentioned negative pressure range.

According to the present invention, the PLC 900 automatically controls the exhaust fan 400, the bypass damper 600, and the blower 800 by means of pressure instruments and a controller (not shown), thereby providing a function of maintaining the negative pressure in the interior of the dryer 100 within the given range.

If the interior of the dryer 100 is higher than a set negative pressure, the PLC 900 controls the exhaust fan 400 to allow a valve of the exhaust fan 400 as the main outlet of the gas to be open to emit the gases and dust from the dryer 100. Next, the PLC 900 controls the exhaust fan 400 to allow the valve of the exhaust fan 400 to be closed to block the gases and dust introduced through the bypass damper 600 and the blower 800 from the dryer 100.

If the interior of the dryer 100 is lower than the set negative pressure, contrarily, the PLC 900 controls the exhaust fan 400 to allow the valve of the exhaust fan 400 as the main outlet of the gas to be closed, and next, the PLC 900 controls the exhaust fan 400 to allow the valve of the exhaust fan 400 to be open to introduce the gases and dust through the bypass damper 600 and the blower 800 from the dryer 100.

Hereinafter, the results for measuring the air pollutant reducing efficiencies through the series of systems according to the present invention are as follows.

(Measurement Results) Amount of dust emitted from asphalt concrete manufacturing equipment (unit: kg/ton)

1. International standard (U.S. EPA) emission permitting coefficient: 16 kg/ton
2. International standard (EU EPA) emission permitting coefficient: 15 kg/ton
3. Domestic standard emission permitting coefficient: 14.4 kg/ton
4. Amount of dust from a new reproductive plant according to the present invention: 10.8 kg/ton As described above, the equipment for reducing specific air pollutants generated from heated asphalt concrete with proportional control according to the present invention can reduce the dust generated while the aggregates to be mixed with asphalt are being heated, change the structure of the dryer for completely burning gases, and control the exhaust fan, the bypass damper, and the blower at the same time by means of the PLC to maintain an appropriate negative pressure in the interior of the dryer, thereby suppressing the generation of the dust, improving combustion efficiency to decrease amounts of gases generated, and in advance preventing environmental pollution caused by the amounts of gases generated.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. Equipment for reducing specific air pollutants generated from heated asphalt concrete with proportional control, the equipment comprising:

a dryer for heating and drying aggregates and for burning harmful gases introduced thereinto through nozzles mounted thereon;

a first dust remover for removing dust from the harmful gases emitted from the dryer and for exhausting the remaining gases and dust therefrom;

a fine dust remover for filtering fine dust from the remaining gases and dust exhausted from the first dust remover through a plurality of filter bags to thus emit clean gas therefrom;

a bypass damper located between the first dust remover and the fine dust remover to return some of the gases and dust emitted from the first dust remover to a second dust remover;

the second dust remover for filtering the dust in the gases and dust emitted from the first dust remover to feed the filtered dust to an asphalt concrete manufacturing silo and to exhaust and feed the gases to the dryer again; and a blower for feeding the gases exhausted from the second dust remover to the dryer through an exhaust pipe, wherein the clean gas exhausted from the fine dust remover is emitted to the air through an exhaust fan and a stack.

2. The equipment according to claim 1, wherein the fine dust remover has a plurality of filter bags located therein, and the fine dust attached to outer peripheral surfaces of the filter bags is dropped by pulsing air and is thus discharged through a fine dust discharge outlet formed on an underside of the fine dust remover, so that the clean gas from which the fine dust is removed is emitted through a gas exhaust outlet formed on an upper portion of the fine dust remover.

3. The equipment according to claim 1, wherein the bypass damper comprises an automatic valve and an actuator for operating the automatic valve, and through operation of the automatic valve, the harmful gases exhausted from the first dust remover are transferred to the second dust remover.

4. The equipment according to claim 1, wherein the second dust remover has a plurality of collection pipes and a plurality of gas exhaust tubes located in a hollow interior space thereof, the plurality of collection pipes having the dust and harmful gases introduced thereinto and the gas exhaust tubes being adapted to upwardly exhaust the gases flowing downward after passing through guide vanes mounted thereon.

5. The equipment according to claim 1, further comprising a programmable logic controller (PLC) for automatically controlling the exhaust fan, the bypass damper, and the blower by pressure instruments and a controller to provide a function of maintaining a negative pressure inside the dryer in a range of −10 to −15 $mmH_2O$.

6. The equipment according to claim 1, wherein the dryer comprises a combustion chamber for burning the gases introduced thereinto through an inlet and the nozzles coupled to a single duct connected to the blower, the single duct being coupled to the inlet formed on top of a side surface of the combustion chamber, and the harmful gases introduced through the inlet being fed to the combustion chamber through the nozzles, each nozzle having an injection angle in a range of 120 to 150° so as to allow the gases introduced into the combustion chamber to be burnt through direct contact with flames of a burner of the dryer.

* * * * *